US005875502A

United States Patent [19]

Kolbenstetter et al.

[11] Patent Number: 5,875,502

[45] Date of Patent: Mar. 2, 1999

[54] SPACE SAVING INSTITUTIONAL BED

[76] Inventors: Gary Kolbenstetter, 11329 Orange Plank Rd., Locust Grove, Va. 22508; Christian D. Baechtel, P.O. Box 676, Fredericksburg, Va. 22404

[21] Appl. No.: 7,050

[22] Filed: Jan. 14, 1998

Related U.S. Application Data

[60] Provisional application No. 60/035,056 Jan. 17, 1997.

[51] Int. Cl.[6] ..... A47C 17/46

[52] U.S. Cl. ..... 5/136; 5/9.1; 5/164; 5/167.1

[58] Field of Search ..... 5/9.1, 133, 136, 5/167, 164.1

[56] References Cited

U.S. PATENT DOCUMENTS

| | | | |
|---|---|---|---|
| D. 217,704 | 6/1970 | Ruben . | |
| 251,489 | 12/1881 | Ware . | |
| 562,269 | 6/1896 | Auerbach | 5/136 X |
| 1,253,549 | 1/1918 | Weaver . | |
| 2,492,362 | 12/1949 | Hopeman, Jr. et al. . | |
| 2,504,769 | 1/1950 | Watter | 5/167 X |
| 2,550,599 | 4/1951 | Reed . | |
| 2,683,883 | 7/1954 | Hirst . | |
| 2,741,779 | 4/1956 | Hopeman, Jr. et al. | 5/9.1 |
| 2,783,717 | 3/1957 | Meldrum . | |
| 3,116,494 | 1/1964 | Bennet et al. . | |
| 3,311,932 | 4/1967 | Ahola | 5/9.1 |
| 3,851,344 | 12/1974 | Zeithammer . | |
| 3,909,857 | 10/1975 | Herrera | 5/164.1 |
| 4,084,276 | 4/1978 | Trexler, Jr. et al. . | |
| 4,103,373 | 8/1978 | Luedtke et al. . | |
| 4,370,766 | 2/1983 | Teague, Jr. | 5/164.1 X |
| 4,476,592 | 10/1984 | Reppas et al. | 5/164.1 |
| 5,353,452 | 10/1994 | Rulis | 5/164.1 |
| 5,446,932 | 9/1995 | Voorhis . | |

*Primary Examiner*—Michael F. Trettel
*Attorney, Agent, or Firm*—Richard C. Litman

[57] ABSTRACT

A space saving institutional bed that is pivoted from a horizontal use position to a vertical non-use position, such that the bed lies flat against the wall upon which it is mounted. The bed includes a body supporting member, two wall mounted brackets, and pivoting assemblies mounted to the brackets and to the body supporting member. A key actuated locking assembly locks the bed in use or non-use positions.

15 Claims, 7 Drawing Sheets

SPACE SAVING INSTITUTIONAL BED

CROSS-REFERENCE TO RELATED APPLICATION

This application claims the benefit of U.S. Provisional Patent Application Ser. No. 60/035,056, filed Jan. 17, 1997 now abandoned.

BACKGROUND OF THE INVENTION

1. Field of the Invention

The present invention relates to a wall mounted bed and, more specifically, to a bed which may be locked in a space saving position, flat against a wall upon which the bed is pivotally mounted.

2. Description of Related Art

In institutions such as state and federal prisons, local and regional jails, adult and juvenile detention centers and the like, beds which may be locked in a non-use position so as to occupy a minimal amount of space are quite desirable. Several space saving beds are disclosed in the related art, including wall mounted beds that may be pivoted from a horizontal use position to a vertical non-use position, in which the bed lies flat against the wall upon which it is mounted. None of the related art, however, discloses a wall mounted bed of the above mentioned type that uses a spring-loaded, locking pin assembly which is actuated by a key so that the position of the bed may be adjusted only by authorized personnel.

U.S. Pat. Nos. 2,550,599 (Reed) and 4,084,276 (Trexler, Jr. et al.) show wall mounted beds that may be pivoted from a horizontal use position to a vertical non-use position in which the bed lies flat against the wall upon which it is mounted.

Neither of the above mentioned beds, has a spring loaded locking pin assembly or a means to limit the ability of unauthorized persons to change the position of the bed.

U.S. Pat. No. 2,783,717, issued Mar. 5, 1957 to Robert A. Meldrum, shows a railway sleeping car with a folding bed which employs a spring loaded locking pin assembly. The bed of Meldrum differs from the present invention in that the locking pin assembly employed is actuated by an easily accessed handle rather than a key which limits the use of the bed. Additionally, the bed of Meldrum, which is held by supports not attached to the wall on which the bed is mounted, is unlike the present invention which is held entirely by a wall mounted support structure to save space.

U.S. Pat. Nos. 251,489 (Ware), 1,253,549 (Weaver), 2,492,362 (Hopeman, Jr. et al.), and 2,683,883 (Hirst) show beds that may be pivoted from a horizontal use position to a vertical non-use position in which the bed lies flat against the wall upon which it is mounted.

U.S. Pat. Nos. 3,116,494 (Bennett et al.), 3,851,344 (Zeithammer), and 5,446,932 (Voorhis) show folding beds which have spring loaded pivoting mechanisms that aid in shifting the position of the beds from use positions to non-use positions.

All of the related art beds discussed require additional supports separate from the wall upon which they are mounted, and none of the above mentioned beds has a means to limit the ability of unauthorized persons to adjust the position of the bed. Furthermore, not one of the above mentioned beds is as of uncomplicated construction as is the present invention.

None of the above inventions and patents, taken either singularly or in combination, is seen to describe the instant invention as claimed. Thus a space saving institutional bed solving the aforementioned problems is desired.

SUMMARY OF THE INVENTION

The present invention is a bed that may be pivoted from a horizontal use position to a vertical non-use position in which the bed lies flat against the wall upon which it is mounted. The bed is made up of a body supporting member, two wall mounted brackets, and a spring loaded locking pin assembly. The body supporting member is attached to the brackets by pivoting assemblies mounted on the corners of the body supporting member adjacent the wall so that the body supporting member may be pivoted within the brackets. The locking pin assembly is mounted on an inner side of the body supporting member adjacent the wall so that two locking pins may extend from the body supporting member into pin receiving holes that are formed on each bracket to lock the body supporting member in a use or non-use position. The locking pin assembly is actuated by a key so that the position of the bed may be adjusted only by authorized personnel.

Accordingly, it is a principal object of the invention to provide a wall mounted bed which may be pivoted into a vertical position flat against the wall to save space.

It is another object of the invention to provide a bed which has a means to limit the ability of unauthorized persons to adjust the position of the bed between use and non-use positions.

It is a further object of the invention to provide a bed which employs a spring loaded locking pin assembly to lock the body supporting portion of the bed in use and non-use positions.

Still another object of the invention is to provide a wall mounted bed which is supported entirely by the wall upon which it is mounted.

It is an object of the invention to provide improved elements and arrangements thereof in a space saving institutional bed for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
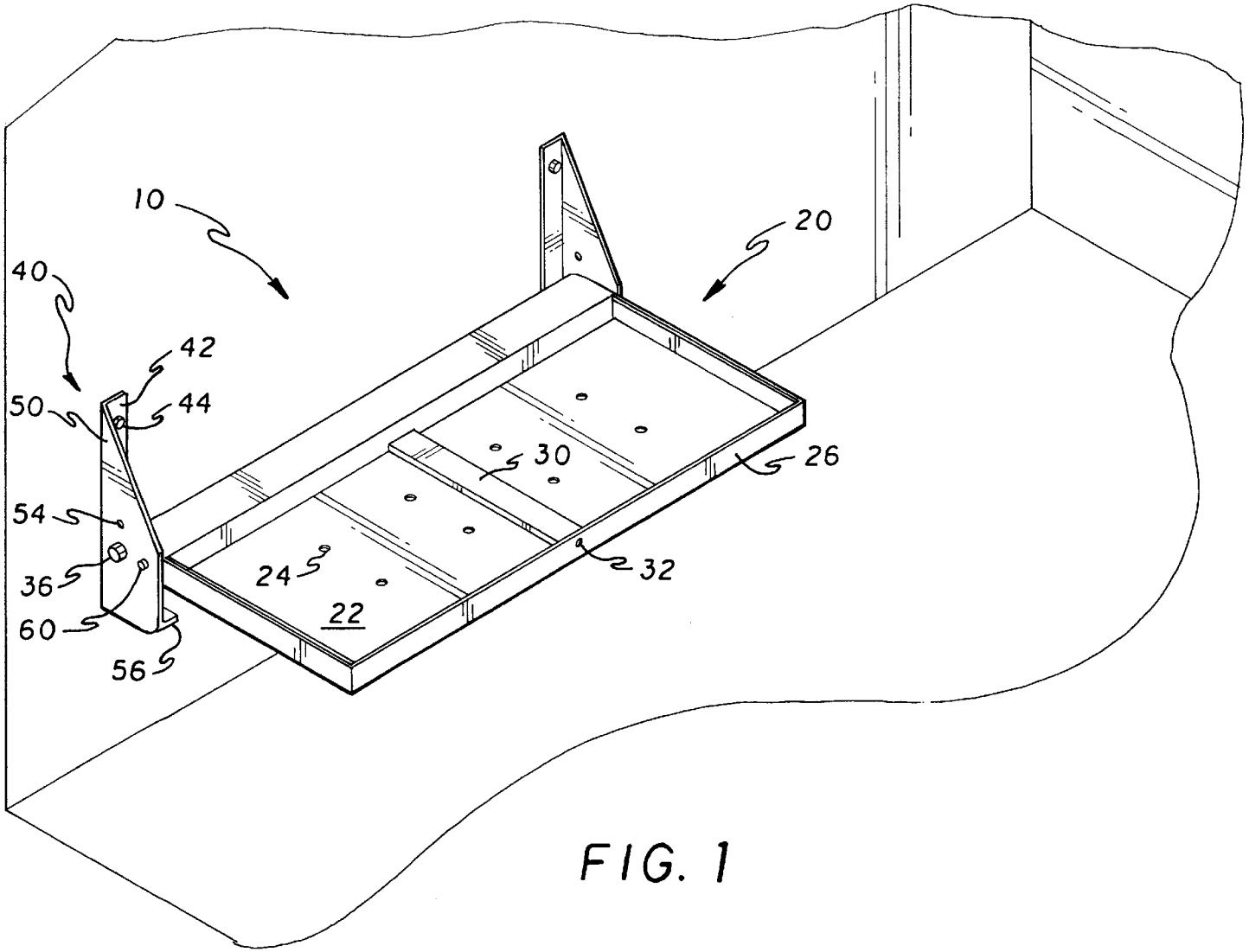
FIG. 1 is an environmental perspective view of a first embodiment of the space saving institutional bed in an extended position.
Figure 2:
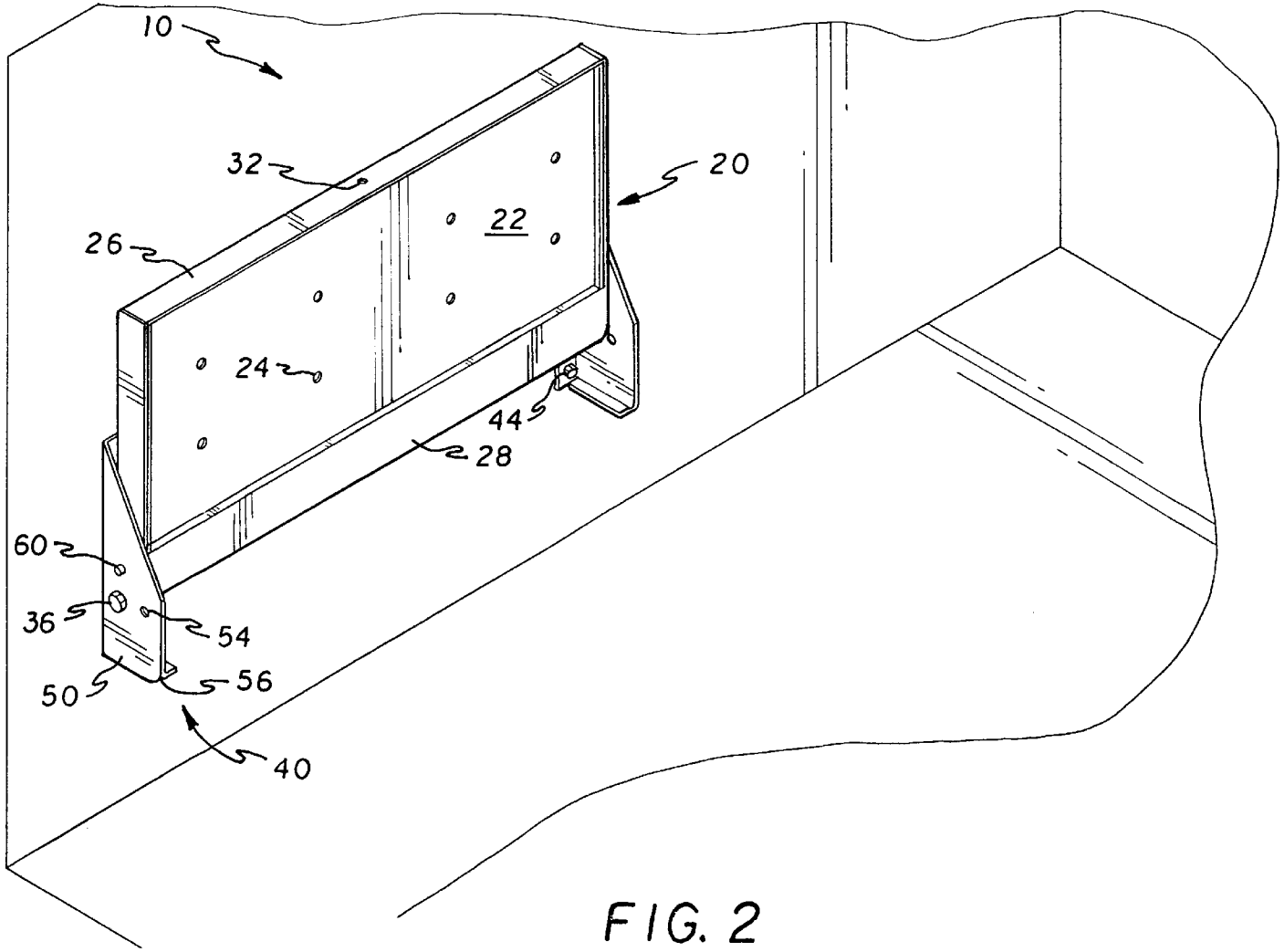
FIG. 2 is an environmental perspective view of the first embodiment of the space saving institutional bed in a folded position.

In the drawings, FIGS. 1–4 illustrate a wall mounted bed 10 with a body supporting member 20 which is pivoted between a horizontal use position illustrated in FIG. 1., and a vertical non-use position, in which the body supporting member 20 lies flat against the wall as illustrated in FIG. 2. The bed 10 also includes two brackets 40 which pivotally support the body supporting member 20, and a locking pin assembly which holds the body supporting member in either a use or non-use position.

The body supporting member 20 is made up of a rectangular metal plate 22 with a frame 26 formed around its edge, a locking pin assembly housing 28, and an lock-actuator axle housing 30. The metal plate 22 and the frame 26 are formed by placing a single sheet of steel in a break machine to bend the edges of the sheet into the frame 26 around the metal plate 22. The metal plate 22 has holes 24 drilled therethrough to allow liquid to drain therethrough so that the body supporting member 20 may be easily cleaned.

Figure 3:
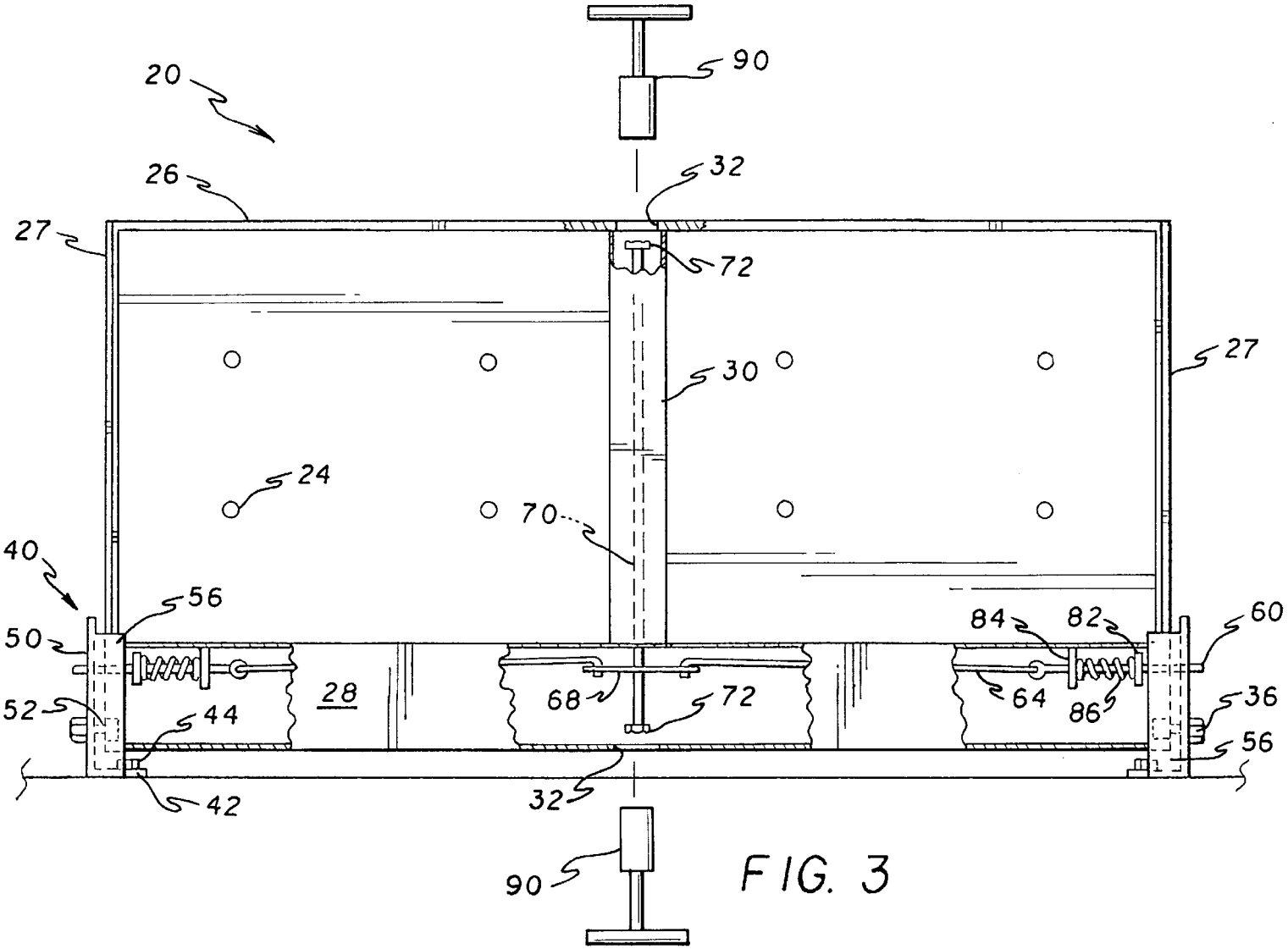
FIG. 3 is a partially exploded top view of FIG. 1 with. portions cut away to show the locking pin assembly in an extended position.

The frame 26 is a rectangular member which is formed integrally around the four sides of the metal plate 22. There are two frame reinforcing members 27 which are fixed to opposite sides of the body supporting member 20 so that the distal ends of the frame reinforcing members 27 extend beyond the corners of the frame 26 adjacent the wall. The distal ends of the frame reinforcing members 27 have holes formed therein for receiving hinge pin assemblies 36 which allow the body supporting member 20 to be pivotally attached to the brackets 40. This is illustrated in FIGS. 3. and 4.

Figure 4:
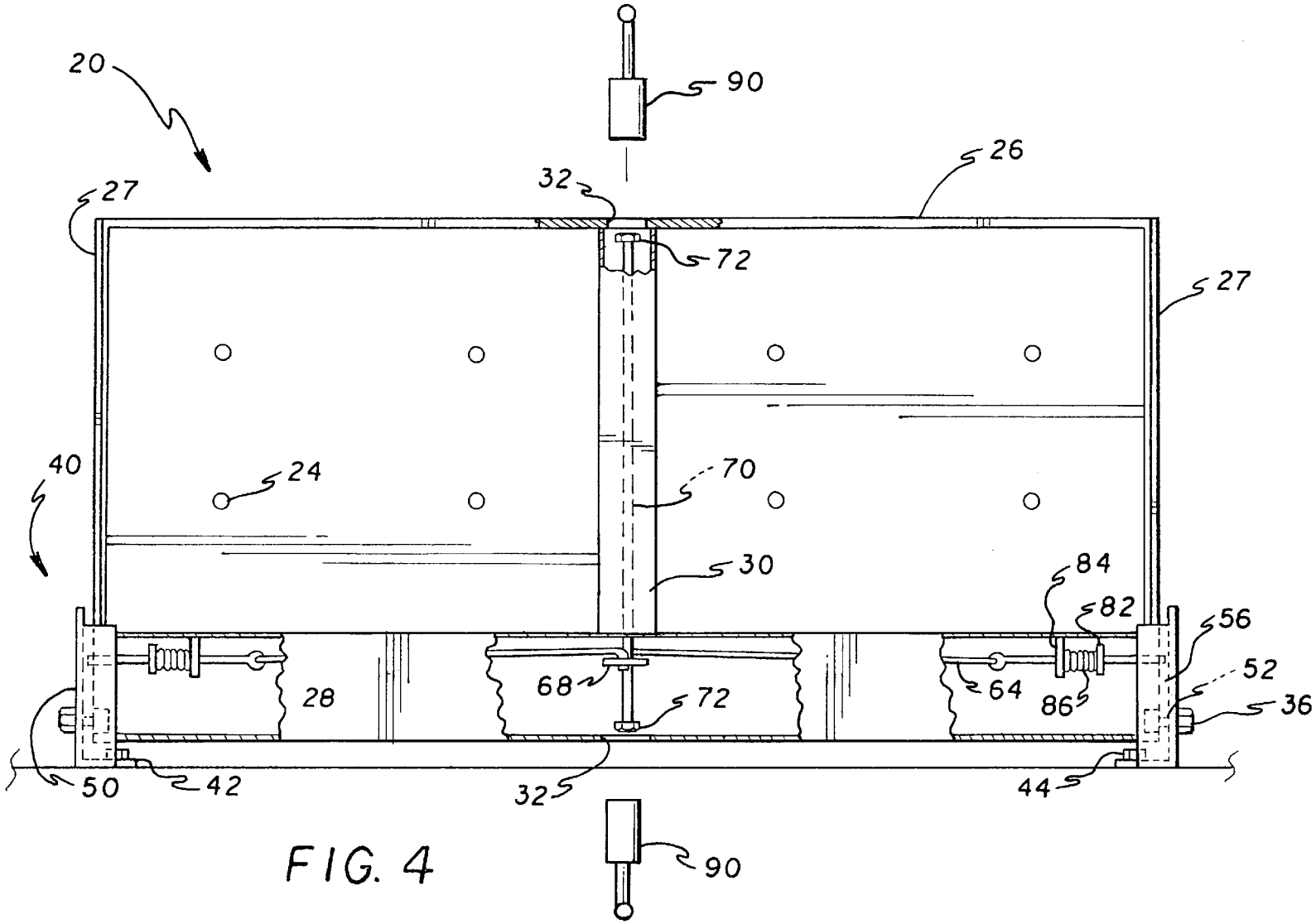
FIG. 4 is a partially exploded top view of FIG. 1 with portions cut away to show the locking pin assembly in a retracted position.

The locking pin assembly housing 28 is attached to an inner side of the frame 26 adjacent the wall along the entire length of that inner side of the frame 26. The locking pin assembly housing 28 is disposed between the distal ends of the frame reinforcing member 27 and the inner side of the frame 26 to which the locking pin assembly housing 28 is attached, so that the housing encloses the hinge pin assemblies 36. This is also illustrated in FIGS. 3 and 4.

The lock-actuator axle housing 30 is fixed to the top of the metal plate 22, extending perpendicularly from the locking pin assembly housing 28 to the inside edge of an outer side of the frame 26, which outer side is parallel to and coextensive with the inner side. The frame 26 and the locking pin assembly housing 28 have key holes 32 formed therein which are aligned with the lock-actuator axle housing 30 to allow a key 90 to be inserted into the lock-actuator axle housing 30. This is illustrated in FIGS. 3 and 4.

The brackets 40 are each made up of a wall attaching member 42 and a bed supporting member 50 which are sheet metal pieces joined in L-fashion. The wall attaching members 42 have holes drilled therethrough adjacent their top and bottom ends so that bolts 44 may be used to secure the brackets 40 to the wall.

When the wall attaching members 42 are bolted to the wall as described above, the bed supporting members 50 will extend perpendicularly therefrom. The bed supporting members 50 each have a hinge pin hole 52 formed therethrough for receiving the hinge pin assemblies 36 to allow the body supporting member to be pivotally attached to the brackets 40. Each bed supporting member 50 also has a tab 56 formed along the bottom edge thereof and at a right angle thereto. The tabs 56 are directed inwardly from the bed supporting members 50 so that they contact the bottom of the body supporting member 20 when the body supporting member 20 is pivoted to a position in which it extends perpendicularly from the wall. This prevents the body supporting member 20 from pivoting beyond a horizontal position. Additionally, the bottom edges of the body supporting members 50 are rounded at the corners furthest from the wall attaching members 42 to prevent any possible injury due to contacting a sharp pointed corner.

Each bed supporting member 50 also has two locking pin holes 54 formed therein at equal distances from the hinge pin hole 52. One locking pin hole 54 is disposed directly above the hinge pin hole 52 and the other locking pin hole is disposed in the same horizontal plane as the hinge pin hole.

The locking pin assembly is enclosed within the locking pin assembly housing 28, and is made up of two locking pins 60 which are connected to a rotating member 68 by two links 64. The locking pin assembly housing 28 has two support plates 84 mounted therein, and disposed equal small distances from the opposite ends thereof. The support plates 84 have holes formed therein which are aligned with holes in the ends of the locking pin assembly housing 28.

The locking pins 60 are cylindrical rods which are located through the holes in the support plates 84 and in the ends of the frame reinforcing members 27 adjacent the wall so that the external ends of the locking pins 60 extend from the body supporting member 20. The links 64 pivotally attach to the internal ends of the locking pins 60 to connect them to opposite ends of the rotating member 68. The rotating member 68 is fixedly attached at its center to a lock-actuator axle 70 held for rotation within the lock-actuator axle housing 30, so that the opposite ends of the lock-actuator axle 70 are disposed adjacent the key holes 32 in the frame 26 and the locking pin assembly housing 28. This allows the rotating member 68 to orbit the longitudinal axis of the lock-actuator axle 70.

Each locking pin 60 has a spring plate 82 attached thereto between the support plate 84 and the end of the locking pin assembly housing 28. Disposed around each locking pin 60 between the support plate 84 and the spring plate 82 is a spring 86, which bears against the support plate 84 and the spring plate 82 to bias the external end of the locking pin 60 out of the locking pin assembly housing 28 and through one of the locking pin holes 54. By biasing the locking pins 60 out of the locking pin assembly housing and away from the lock-actuator axle 70, the links 60 are also biased away from the lock-actuator axle 70, thereby biasing the ends of the rotating member 68 into a position aligned on an axis between the lock-actuator axle 70 and the locking pins 60.

When the locking pins 60 are disposed through the locking pin holes 54 directly above the hinge pin holes 52, the body supporting member 20 is held in a vertical non-use position flat against the wall. When the locking pins 60 are disposed through the locking pin holes 54 in the same horizontal plane as the hinge pin holes 52, the body supporting member is held in a horizontal use position.

In order to pivot the body supporting member 20 between use and non-use positions, the external ends of the locking pins 60 must be retracted from their biased position extending through the locking pin holes 54. This is accomplished by turning the lock-actuator axle 70. A hexagonal nut 72 is fixedly attached to each end of the lock-actuator axle 70 so that the key 90, which is adapted to engage each of the nuts 72, may be inserted through one of the key holes 32 and used to turn the nut 72 and therefore the lock-actuator axle 70.

By using the key 90 to turn the lock-actuator axle 70 a quarter turn, the ends of the rotating member 68 will be urged away from the ends of the locking pin assembly housing 28, thereby urging the links 64 inward, and thereby urging the locking pins 60 into a retracted position in which the springs 86 are compressed. The body supporting member 20 may then be pivoted to a new position within the brackets 40 and locked in place by releasing the key 90, thereby allowing the locking pins to be urged through the locking pin holes 54 by the compressed springs 86.

Figure 5:
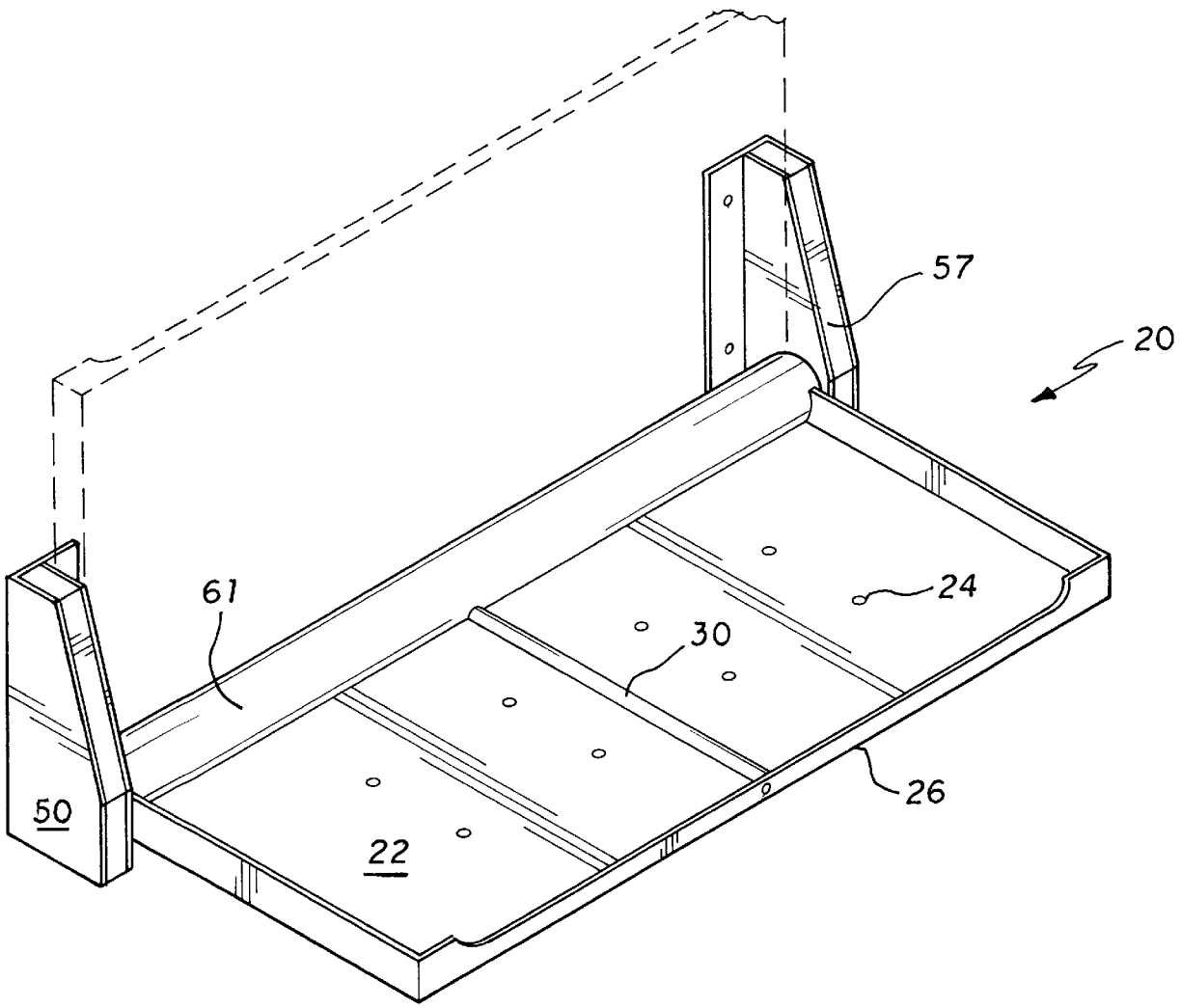
FIG. 5 is an environmental perspective view of a second embodiment of the space saving institutional bed in an extended position with the folded position shown in phantom lines.
Figure 6:
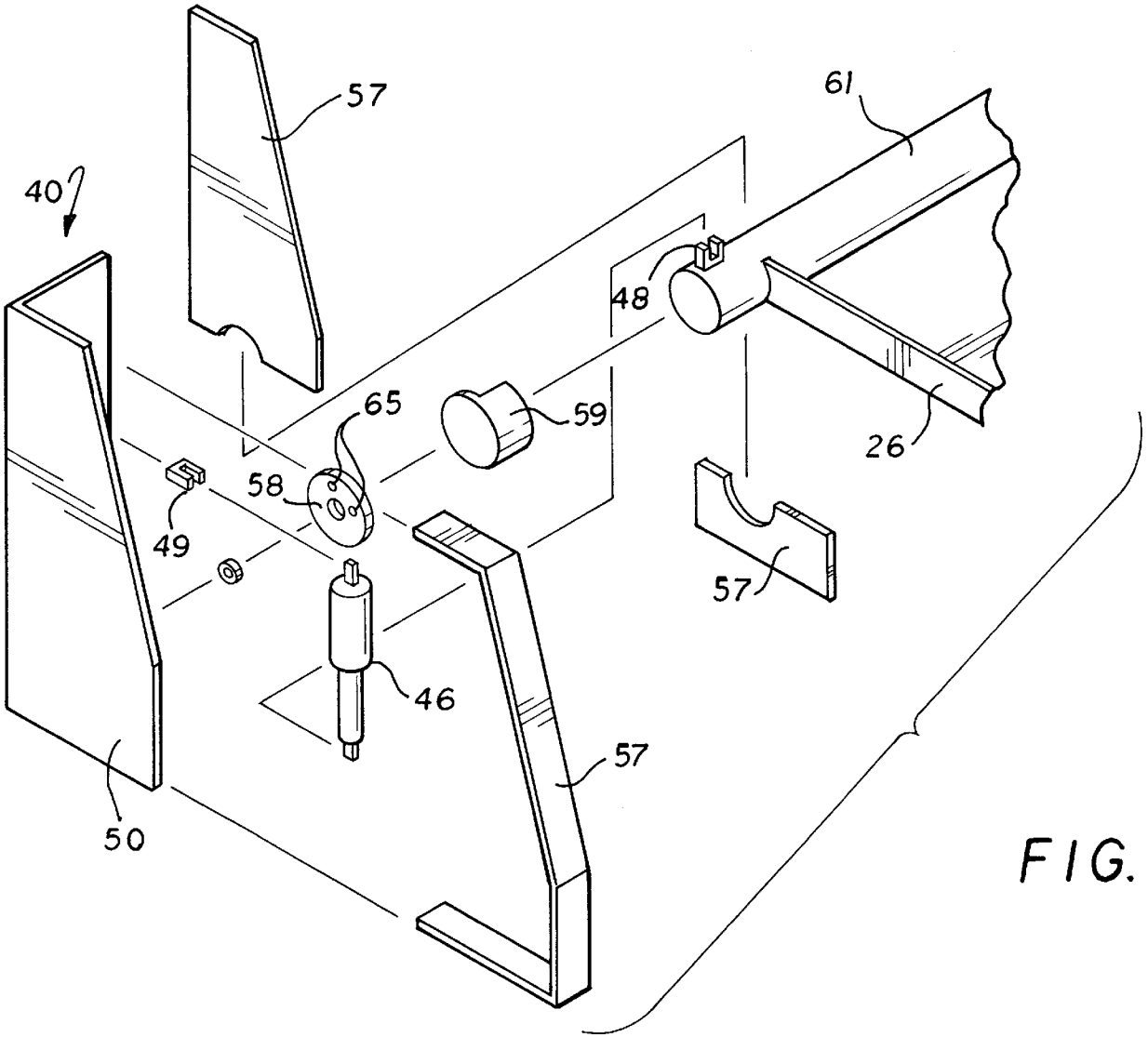
FIG. 6 is a fragmentary perspective, exploded view of the second embodiment showing internal elements enclosed within the brackets.
Figure 7:
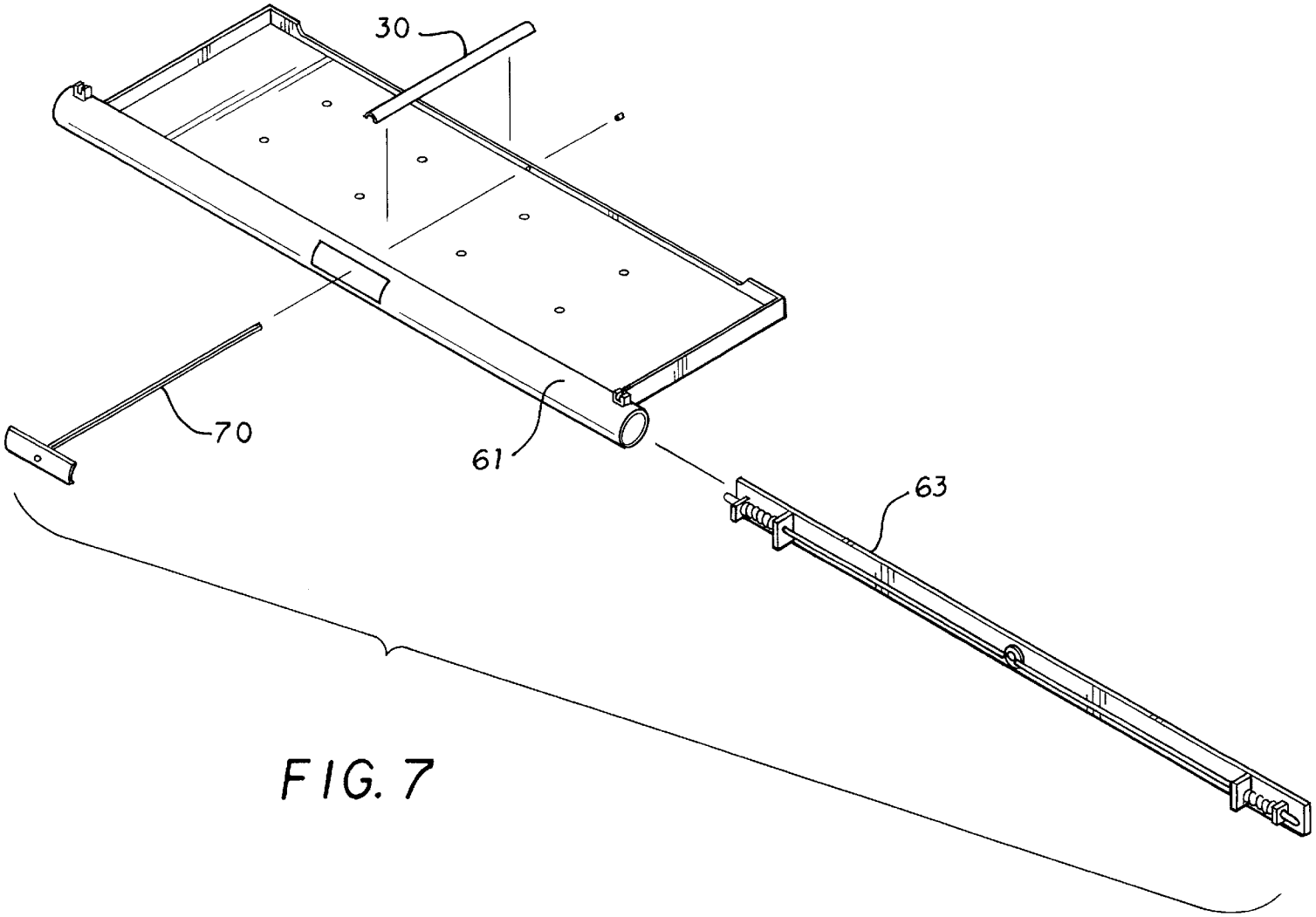
FIG. 7 is a partially exploded perspective view showing the locking pin assembly of the second embodiment.

Another embodiment of the space saving bed is illustrated in FIGS. 5–7. As shown most clearly in FIG. 7, the locking pin assembly housing is a cylindrical tube 61. Frame 26 is attached to the tube, by welding or the like, to form a rectangular structure defining the body support member. A flat metal bar 63 of stock material has the locking pin assembly fastened thereon. The bar 63, with the locking pin assembly fastened thereon, is inserted into the tube 61. The bar 63 extends the entire length of tube 61 and is attached to the tube by any suitable means.

Gas spring members 46, one of which is shown in FIG. 6, are positioned at each end of the tube 61 and adjacent to the brackets 40. A lower end of each gas spring member is pivotally fastened to the cylindrical tube at 48. The gas spring members are pivotally fastened at their upper ends to the brackets at 49. The gas spring members provide a lifting assist for the bed and also provide support to hold the bed in the horizontal use position in lieu of tabs 56.

A locking plate 58 and a bushing 59 are fixed to member 50 on each bracket. Locking pin holes 65 are formed in each locking plate 58 in the same corresponding positions as locking pin holes 54. When assembled, each end of tube 61 is positioned in a respective bushing 59. Cover members 57 are affixed to each bracket to fully enclose the assembled structure.

The embodiment of FIGS. 5–7 functions essentially the same as the embodiment of FIGS. 1–4. Key 90 is inserted into opening 32 to engage and rotate lock-actuator axle 70. Assuming that the bed is in the horizontal use position, rotation of the lock-actuator axle will function to extract the locking pins 60 from the lower positioned locking pin holes 65 formed in locking plates 58. The bed can then be pivoted upwardly to a vertical position flat against the wall. Gas springs will provide a lifting assist of all but 20 lbs. of the bed's weight. At the vertical position, upon releasing the key, compressed springs 86 will bias the locking pins into engagement with the upper positioned holes 65 formed in locking plates 58. Thus, the bed is locked in the vertical position and all essential parts are effectively covered.

It is to be understood that the present invention is not limited to the embodiments described above, but encompasses any and all embodiments within the scope of the following claims.

We claim:

1. A space saving bed adapted to be mounted on a vertical surface, comprising:

a body supporting member having a top surface, an inner side and an outer side, said outer side spaced from said inner side and parallel thereto, said inner side having first and second ends and having a horizontal longitudinal axis positioned parallel with and adjacent to the vertical surface for mounting the bed, said outer side being coextensive with said inner side;

bracket means mounted on said vertical surface, wherein said bracket means is L-shaped and wherein said bracket means is mounted such that a side of the L extends perpendicularly to the vertical surface for mounting the bed;

pivot means attaching said bracket means to said first and second ends, said pivot means allowing the body supporting member to move from a horizontally disposed, use position to a vertically disposed, non-use position;

support means fixed to said bracket means for supporting said body supporting member in the horizontally disposed use position, wherein said support means comprise tabs fixed along a bottom edge of the perpendicularly extending side of the bracket means;

a locking assembly enclosed within said inner side;

locking assembly engagement means positioned on said bracket means; and a key for actuating said locking assembly.

2. A space saving bed as defined in claim 1, wherein said pivot means comprise hinge pins mounted to said bracket means and to said first and second ends of the inner side.

3. A space saving bed as defined in claim 1, wherein said locking assembly comprises first and second locking pins, spring means for biasing said first and second locking pins to an extended position and into engagement with the locking assembly engagement means, and linkage means for moving said first and second locking pins to a retracted position out of engagement with said locking assembly engagement means.

4. A space saving bed as defined in claim 3, wherein said linkage means includes a lock-actuator axle having a longitudinal axis which extends perpendicularly from said inner side to said outer side, said lock-actuator axle having opposite ends and wherein said opposite ends are respectively adjacent said inner and outer sides.

5. A space saving bed as defined in claim 4, wherein said inner and outer sides have respective openings in alignment with the opposite ends of the lock-actuator axle and wherein said lock-actuator axle is rotatable about said longitudinal axis, said key being adapted for insertion through said respective openings to engage and rotate said lock-actuator axle.

6. A space saving bed as defined in claim 4, wherein said lock-actuator axle is positioned on said top surface, there further being a cover member attached to said top surface, said cover being dimensioned and configured to enclose said lock-actuator axle.

7. A space saving bed as defined in claim 1, wherein the locking assembly engagement means comprise means defining holes formed in said bracket means.

8. A space saving bed adapted to be mounted on a vertical surface, comprising:

a body supporting member having a top surface, an inner side and an outer side, said outer side spaced from said inner side and parallel thereto, said inner side having first and second ends and having a horizontal longitudinal axis positioned parallel with and adjacent to the vertical surface for mounting the bed, said outer side being coextensive with said inner side;

bracket means mounted on said vertical surface;

pivot means attaching said bracket means to said first and second ends, said pivot means allowing the body supporting member to move from a horizontally disposed, use position to a vertically disposed, non-use position;

support means fixed to said bracket means for supporting said body supporting member in the horizontally disposed use position;

a locking assembly enclosed within said inner side, wherein the locking assembly is enclosed within a box having a rectangular configuration;

locking assembly engagement means positioned on said bracket means; and a key for actuating said locking assembly.

9. A space saving bed as defined in claim 8, there further being a wall in the box, the locking assembly being attached to said wall of the box.

10. A space saving bed adapted to be mounted on a vertical surface, comprising:

a body supporting member having a top surface, an inner side and an outer side, said outer side spaced from said inner side and parallel thereto, said inner side having first and second ends and having a horizontal longitudinal axis positioned parallel with and adjacent to the vertical surface for mounting the bed, said outer side being coextensive with said inner side;

bracket means mounted on said vertical surface;

pivot means attaching said bracket means to said first and second ends, said pivot means allowing the body supporting member to move from a horizontally disposed, use position to a vertically disposed, non-use position;

support means fixed to said bracket means for supporting said body supporting member in the horizontally disposed use position;

a locking assembly enclosed within said inner side;

a tube of cylindrical configuration, the locking assembly being enclosed within said tube of cylindrical configuration and wherein said first and second ends of said inner side are the ends of said tube;

locking assembly engagement means positioned on said bracket means; and a key for actuating said locking assembly.

11. A space saving bed as defined in claim 10, there further being a metal bar, the locking assembly being fixed to said metal bar, and said metal bar being fixed inside of said tube.

12. A space saving bed as defined in claim 11, further including bushings attached to said bracket means, said tube having opposed ends which are positioned in said bushings.

13. A space saving bed as defined in claim 10, wherein said pivot means comprise gas springs mounted to said bracket means and to said first and second ends of said inner side.

14. A space saving bed as defined in claim 10, wherein the locking assembly engagement means comprise locking plates fixed on said bracket means.

15. A space saving bed adapted to be mounted on a vertical surface, comprising:

a body supporting member having a top surface, an inner side and an outer side, said outer side spaced from said inner side and parallel thereto, said inner side having first and second ends and having a horizontal longitudinal axis positioned parallel with and adjacent to the vertical surface for mounting the bed, said outer side being coextensive with said inner side;

bracket means mounted on said vertical surface, wherein said bracket means is L-shaped and wherein said bracket means is mounted such that a side of the L extends perpendicularly to the vertical surface for mounting the bed;

pivot means attaching said bracket means to said first and second ends, said pivot means allowing the body supporting member to move from a horizontally disposed, use position to a vertically disposed, non-use position;

support means fixed to said bracket means for supporting said body supporting member in the horizontally disposed use position, wherein the support means comprise gas springs mounted to said bracket means and to said first and second ends of the inner side;

a locking assembly enclosed within said inner side;

locking assembly engagement means positioned on said bracket means; and a key for actuating said locking assembly.

* * * * *